US007134297B2

(12) United States Patent
Corduan et al.

(10) Patent No.: US 7,134,297 B2
(45) Date of Patent: Nov. 14, 2006

(54) LOW-TEMPERATURE AIR FRACTIONATION PROCESS

(75) Inventors: Horst Corduan, Puchheim (DE); Dietrich Rottmann, München (DE)

(73) Assignee: Linde AG, Wiesbaden (DE)

( * ) Notice: Subject to any disclaimer, the term of this patent is extended or adjusted under 35 U.S.C. 154(b) by 650 days.

(21) Appl. No.: 10/365,610

(22) Filed: Feb. 13, 2003

(65) Prior Publication Data

US 2004/0055331 A1 Mar. 25, 2004

(30) Foreign Application Priority Data

Feb. 13, 2002 (DE) ..... 102 05 878
May 2, 2002 (EP) ..... 02009897

(51) Int. Cl.
*F25J 3/00* (2006.01)

(52) U.S. Cl. ..... 62/643; 62/903

(58) Field of Classification Search ..... 62/643, 62/903

See application file for complete search history.

(56) References Cited

U.S. PATENT DOCUMENTS 4,606,745 A * 8/1986 Fujita ..... 165/166
5,122,174 A * 6/1992 Sunder et al. ..... 62/654
5,699,671 A 12/1997 Lockett et al.
RE36,435 E 12/1999 Grenier et al.
6,351,968 B1 * 3/2002 Habicht et al. ..... 62/643

FOREIGN PATENT DOCUMENTS

EP 0 926 457 A2 6/1999

* cited by examiner

*Primary Examiner*—William C. Doerrler
(74) *Attorney, Agent, or Firm*—Millen, White, Zelano, Branigan, P.C.

(57) ABSTRACT

The invention relates to a process for the low-temperature fractionation of air in a rectification unit, which comprises a pressure column (1) a low-pressure column (2) and a condenser-evaporator system having at least two falling-film evaporators (203, 204). Oxygen-rich liquid from the low-pressure column (2) is introduced into the evaporation passages of the first and second falling-film evaporators (203, 204) and is partially evaporated. Unevaporated oxygen-rich liquid from the first falling-film evaporator (203) is transferred into the evaporation passages of the second falling-film evaporator (204).

28 Claims, 4 Drawing Sheets

PRIOR ART

LOW-TEMPERATURE AIR FRACTIONATION PROCESS

Figure 1:
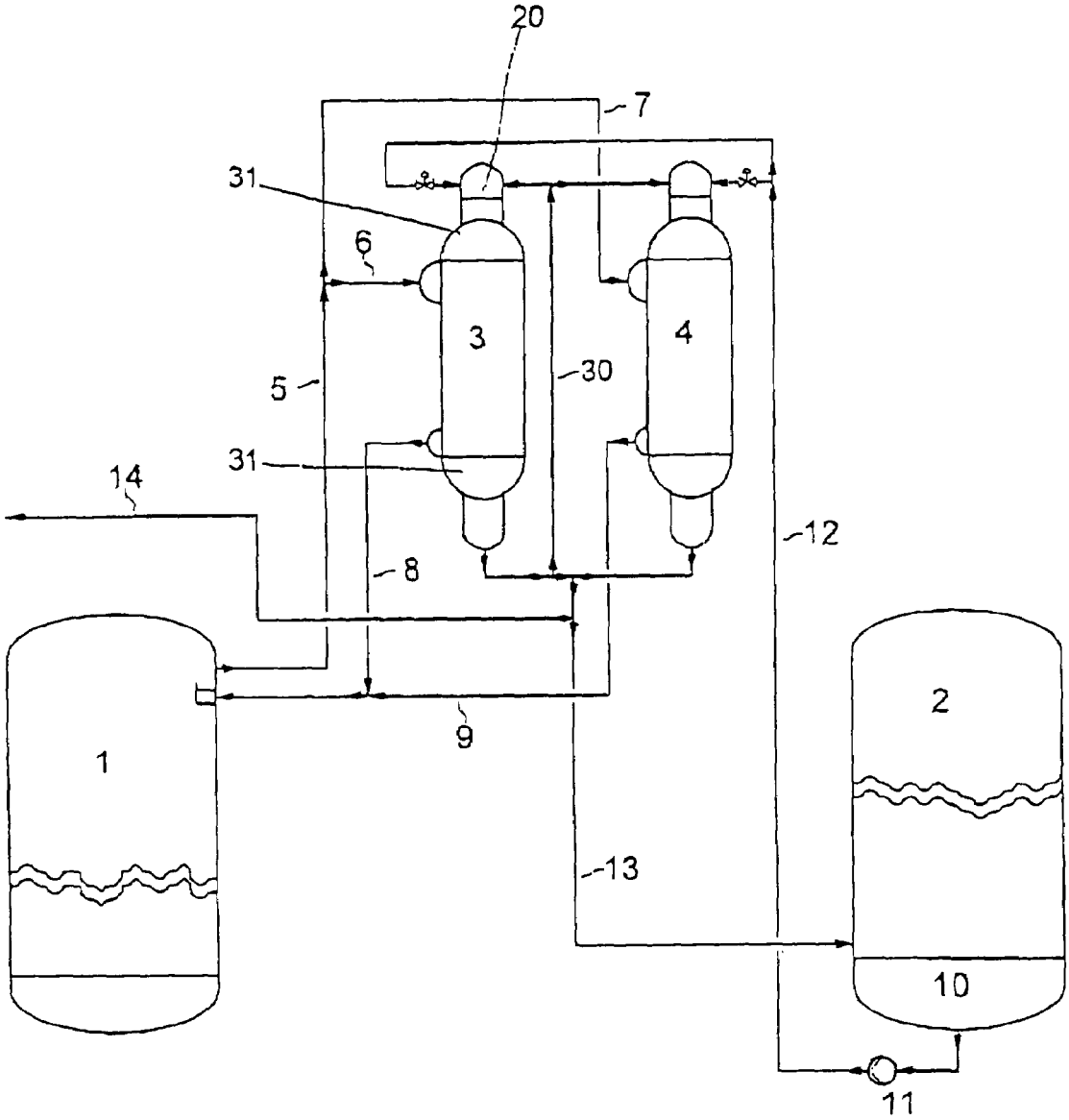

The invention relates to a process for the low-temperature fractionation of air in a rectification unit, which comprises a pressure column, a low-pressure column and a condenser-evaporator system with at least two falling-film evaporators, oxygen-rich liquid from the low-pressure column being introduced into the evaporation passages of the first falling-film evaporator and partially evaporated, and unevaporated oxygen-rich liquid from the first falling-film evaporator being passed into the second falling-film evaporator.

In a low-pressure air fractionation plant having a pressure column and a low-pressure column, liquid oxygen from the low-pressure column is evaporated against gaseous nitrogen from the top of the pressure column by indirect heat exchange, during which the nitrogen condenses. A condenser-evaporator system of this type is generally referred to as the main condenser.

In practice, the main condenser is almost always formed as a circulation condenser or as a falling-film evaporator. In the case of a circulation condenser, the condenser block stands in a bath of the liquid which is to be evaporated. The liquid which is to be evaporated enters the evaporation passages from below and is at least partially evaporated by heat exchange against the heating medium flowing through the liquefaction passages. The gas which is formed during the evaporation entrains liquid from the bath into the evaporation passages. This thermosiphon effect results in the formation of a natural circulation of liquid through the circulation condenser without there being any need for further means for conveying liquid.

By contrast, in the case of a falling-film evaporator, the liquid which is to be evaporated is introduced into the evaporation passages from above via a distribution system, which simultaneously forms a gas closure. The liquid runs downwards along the walls which separate the evaporation passages and the liquefaction passages as a film of liquid and is partially evaporated. The vapour which is formed and the unevaporated residual liquid emerge from the falling-film evaporator at the bottom. This type of evaporator has a particularly low pressure loss in the evaporation passages and therefore in terms of energy is generally more suitable than a circulation evaporator.

However, when an oxygen-rich liquid is being evaporated, total evaporation, which causes the evaporation passages to run dry, must be prevented. For this purpose, it is generally the case that a significantly larger quantity of liquid than is actually to be evaporated is added to the evaporation passages, so that in addition to the desired vapour there is always a certain quantity of excess liquid which emerges from the evaporation passages. However, delivering excess liquid to the evaporation passages runs contrary to the energy-saving effect of the falling-film evaporator.

In EP-A 0 926 457, it is proposed for two or more falling-film evaporators to be arranged above one another between the bottom of the low-pressure column and the lowermost mass transfer elements of the low-pressure column. The individual falling-film evaporators are arranged in series. The oxygen-rich liquid which emerges from the mass transfer elements is collected and introduced into the first falling-film evaporator. Unevaporated liquid from the first falling-film evaporator is then transferred into the second falling-film evaporator arranged below it. There is no provision for liquid to be recirculated from the bottom of the low-pressure column into the falling-film evaporators.

In the event of load changes, the ratio of the liquid dropping out of the low-pressure column and the gaseous nitrogen formed at the top of the pressure column may change, at least temporarily. In the condenser-evaporator system described in EP-A 0 926 457, this can lead to the ratio of the liquid which enters the evaporation passages to the heating medium flowing in the evaporation passages decreasing. In the event of such a lack of equilibrium between the quantities of heating medium and lipid to be evaporated, the evaporation passages may run dry and relatively low-volatility substances can accumulate therein.

U.S. Re. 36,435 has likewise disclosed a low-temperature fractionation plant with two falling-film evaporators arranged above one another. To start up the plant, only the upper falling-film evaporator is fed with liquid from the bottom of the low-pressure column, while only the liquid which emerges from the first evaporator enters the downstream falling-film evaporator. In normal operation, by contrast, liquid from the bottom of the low-pressure column is only pumped into the lower falling-film evaporator. The upper evaporator is fed only with the liquid which emerges from the mass transfer elements of the low-pressure column. In a plant of this type, the problem exists that undefined quantities of fluid are fed to the upper falling-film evaporator, in particular in the event of load changes, with the result that the evaporation passages, as described above, may run dry.

In the case of relatively large air fractionation plants, which are equipped with more than one falling-film evaporator, therefore, hitherto the individual falling-film evaporators have been connected and operated not in series but rather in parallel. For this purpose, however as described above, a corresponding quantity of excess liquid has to be pumped to each falling-film evaporator, which has an adverse effect on the energy balance.

Therefore, the present invention is based on the object of providing a process of the type described in the introduction which is particularly favourable in terms of energy and operating technology and in which the accumulation of relatively low-volatility substances in the falling-film evaporators is avoided.

This object is achieved by a process of the type described in the introduction, in which oxygen-rich liquid from the bottom of the low-pressure column is introduced into the evaporation passages of the first falling-film evaporator and into the evaporation passages of the second falling-film evaporator.

According to the invention, the evaporation passages of the second falling-film evaporator are fed with unevaporated liquid from the first falling-film evaporator. For safety reasons, in order to prevent the falling-film evaporator from running dry, liquid from the bottom of the low-pressure column is fed into the evaporation passages of the first falling-film evaporator. Total evaporation of the liquid also has to be avoided in the evaporation passages of the second falling in evaporator. In this context, it is possible to supply the first falling-film evaporator with so much liquid from the bottom of the low-pressure column that sufficient unevaporated liquid remains to be passed on to the second falling-film evaporator.

According to the invention, however, so much liquid is added to the first falling-film evaporator that it does not run dry, even when a safety factor is taken into account. The second falling-film evaporator is supplied firstly with unevaporated liquid from the first falling-film evaporator and secondly with a suitable quantity of liquid from the bottom of the low-pressure column, so that it is prevented from running dry.

The mixture of generated vapour and unevaporated liquid which emerges from the first falling-film evaporator is advantageously separated into a fraction which substantially includes vapour and a traction which substantially includes liquid. Only the liquid is passed on into the second falling-film evaporator. The vapour fraction is returned to the low-pressure column or removed from the plant as gaseous product.

Of course, the invention is not restricted to just two falling-film evaporators being arranged in series one behind the other. Depending on the type and size of plant, it has also proven favourable for three or more falling-film evaporators to be arranged in series, i.e. for the unevaporated liquid which emerges from the second falling-film evaporator to be fed to a third falling-film evaporator. Furthermore, it may be advantageous if one or more further falling-film evaporators are connected in parallel with respect to the first and/or second falling-film evaporators. In this case, the liquid which emerges from the first falling-film evaporator and all the falling-film evaporators which are connected in parallel therewith is preferably combined and distributed to the second falling-film evaporator and any falling-film evaporators arranged in parallel therewith.

It is advantageous for the amount of oxygen-rich liquid fed to the first and second falling-film evaporators to be two to five times the amount of oxygen in vapour form produced in the corresponding falling-film evaporator. This procedure ensures that running dry i.e. total evaporation of the liquid oxygen, cannot occur. For the second falling-film evaporator, it is merely necessary to add the amount of liquid which has evaporated in the first falling-film evaporator from the bottom of the low-pressure column. In other words, two to five times as much liquid from the bottom of the low-pressure column is fed to the first falling-film evaporator as to the second falling-film evaporator.

It is preferable for the individual falling-film evaporators to be arranged in such a way that the liquid which emerges from the first falling-film evaporator flows into the second falling-film evaporator without the use of a pump, purely under the force of gravity. Of course, a corresponding statement is also true for the flow communication between the second falling-film evaporator and any third falling-film evaporator.

Furthermore, the falling-film evaporators are preferably arranged in such a way that the condensed nitrogen which emerges from the second (or third) falling-film evaporator flows back into the pressure column on account of static pressure and the unevaporated liquid oxygen which emerges from the second (or third) falling-film evaporator flows back into the low-pressure column on account of static pressure, in order to save on pumps or other delivery devices.

Figure 2:
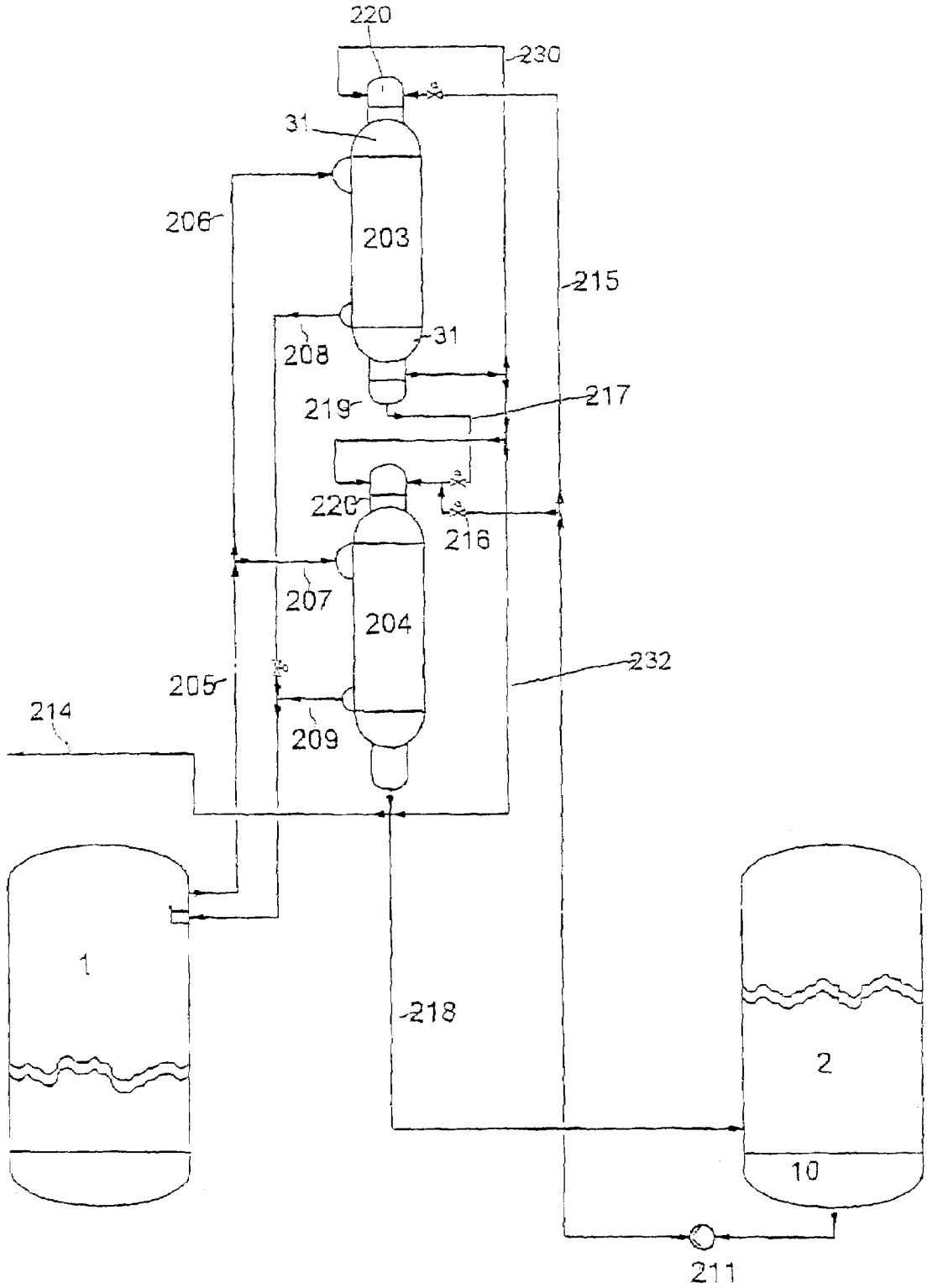
Figure 3:
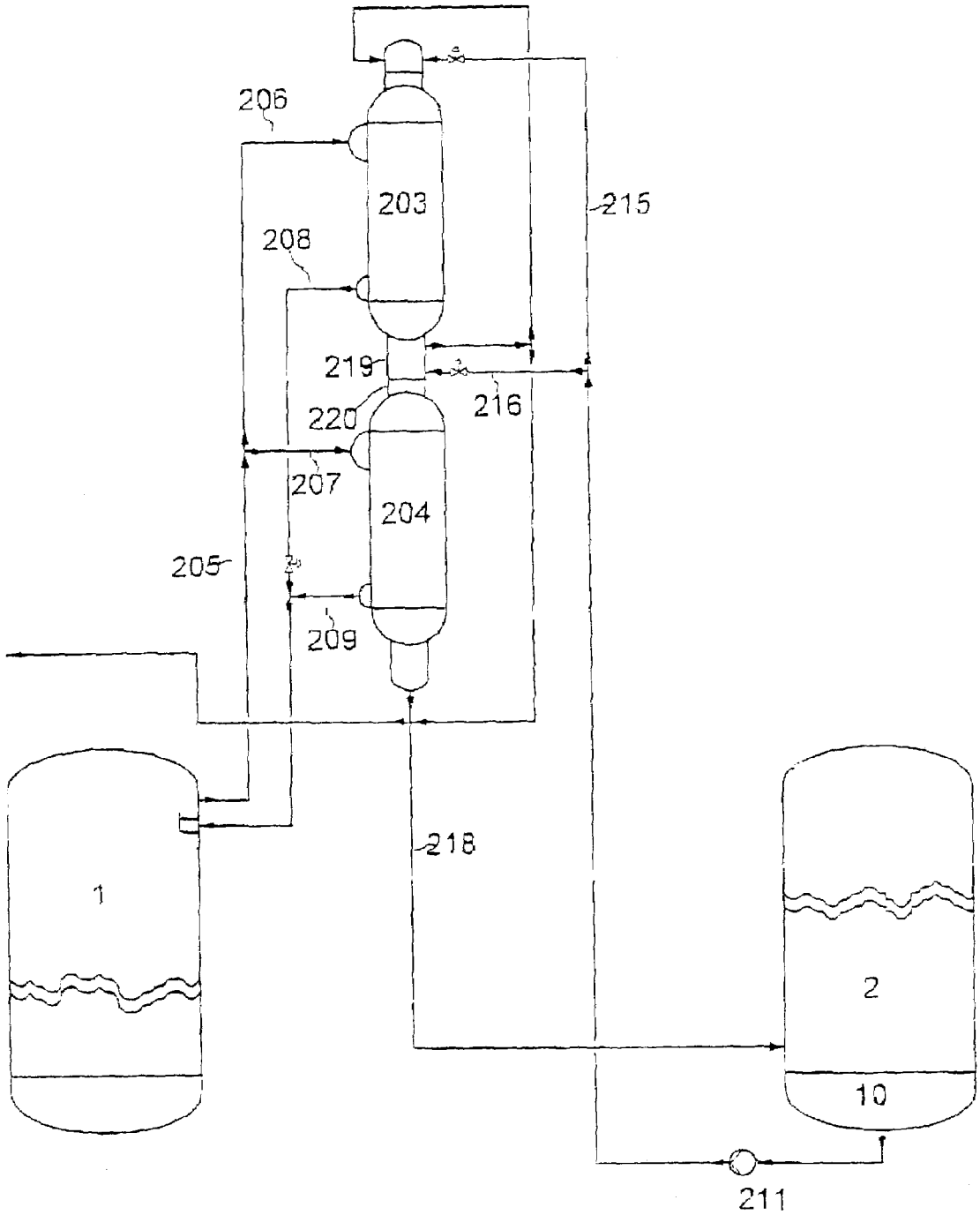
Figure 4:
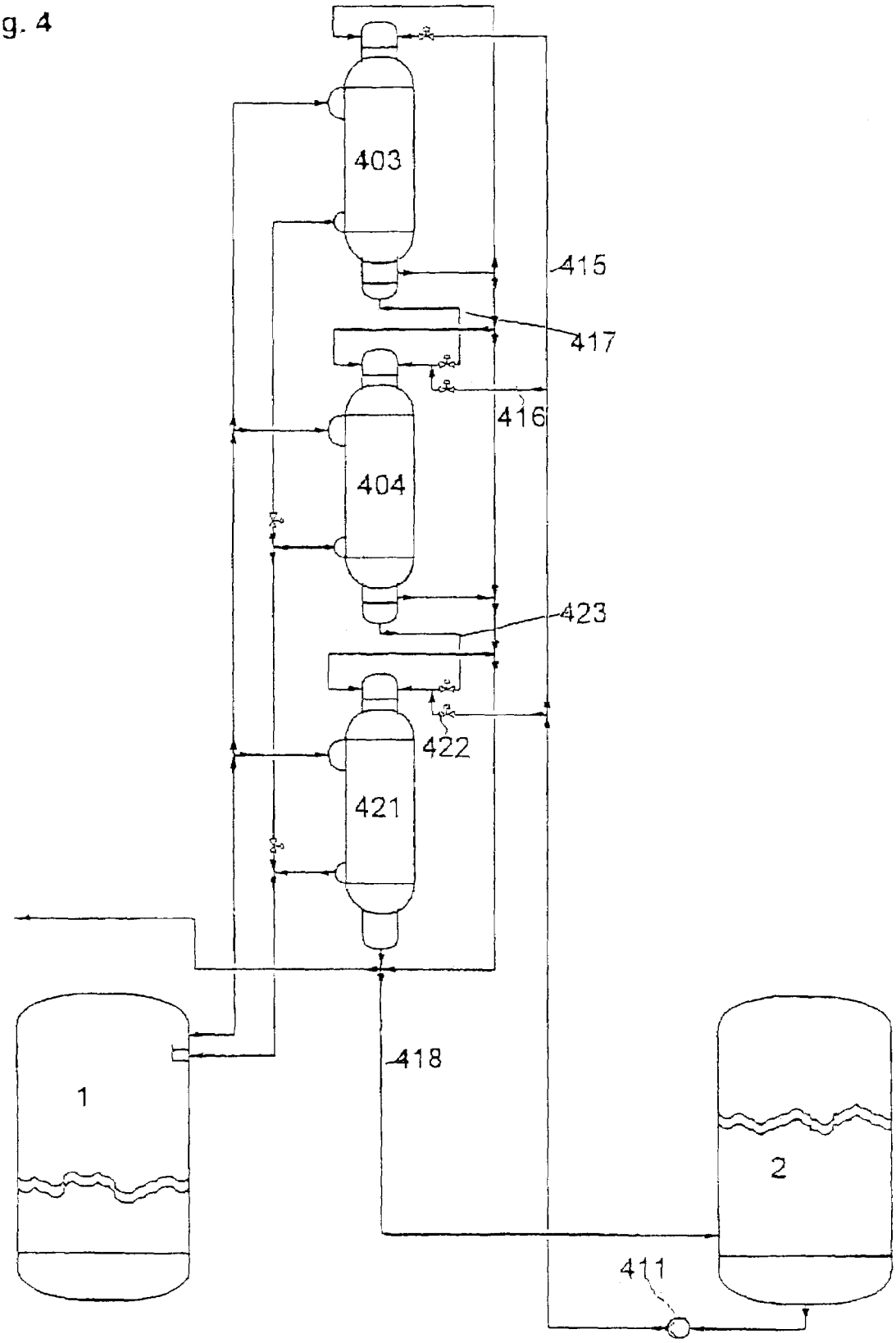

The intention and further details of the invention are explained in more detail below with reference to exemplary embodiments illustrated in the drawing, in which:

FIG. 1 shows the arrangement of two falling-film evaporators as the main condenser of an air fractionation plant according to the prior art, FIG. 2 shows the arrangement according to the invention of two falling-film evaporators as the main condenser, FIG. 3 shows an alternative embodiment of the arrangement shown in FIG. 2, and FIG. 4 shows the arrangement according to the invention of three falling-film evaporators.

FIG. 1 diagrammatically depicts a rectification unit for low-temperature fractionation of air, having a pressure column 1 and a low-pressure column 2, as known from the prior art. For the sake of clarity, the figure is restricted to the components which are of relevance to the heat exchange between the pressure column 1 and the low-pressure column 2. The rectification unit shown has two falling-film evaporators 3, 4, which are used as the main condenser of the air fractionation plant. The pressure column 1 and the low-pressure column 2 are arranged next to one another, and the falling-film evaporators 3, 4 are located above the pressure column 1.

Gaseous nitrogen is extracted at the top of the pressure column 1 via line 5 and is introduced via the lines 6 and 7 into the respective liquefaction passages of the falling-film evaporators 3 and 4, respectively. The nitrogen which emerges from the liquefaction passages of the two falling-film evaporators 3, 4 is then fed back to the top of the pressure column 1 as reflux liquid via the lines 8 and 9, respectively. The falling-film evaporators 3, 4 are arranged in such a way that after the condensation in the falling-film evaporators 3, 4, the nitrogen can run back into the pressure column 1 with a gradient, without a pump being required.

The oxygen-rich liquid which accumulates in the bottom 10 of the low-pressure column 2 is conveyed upwards to the two falling-film evaporators 3, 4 via line 12 with the aid of a pump 11 and is throttled into a level vessel 20 which is connected to the upper header 31 of the corresponding falling-film evaporator 3, 4. A certain liquid level above the evaporation passages is maintained in the level vessel 20. This level firstly provides the required static pressure in order to convey the vapour which is formed in the evaporation passages and the unevaporated liquid downwards through the evaporation passages. Secondly, this liquid level ensures that no vapour from the top space of the falling-film evaporators 3, 4 enters the corresponding evaporation passages.

The oxygen-rich liquid is partially evaporated in the evaporation passages. The vapour-liquid mixture is then returned to the low-pressure column 2 via line 13. A further line 14, via which oxygen in vapour form can be removed as product of the plant, branches off from line 13. A line 30 which connects the upper and lower headers 31 of the two falling-film evaporators 3, 4 is used to compensate for any excess or reduced pressure in one of the headers 31.

To prevent the two falling-film evaporators 3, 4 from running dry, they are operated with an excess of oxygen-rich liquid. By way of example, 100,000 $m^3$/h (s.t.p.) of oxygen are evaporated in the main condenser, i.e. 50,000 $m^3$/h (s.t.p.) of oxygen are produced in each falling-film evaporator 3, 4. For safety reasons, three times the quantity of liquid oxygen, i.e. in each case 150,000 $m^3$/h (s.t.p.), are applied to the falling-film evaporators 3, 4. In total, therefore, 300,000 $m^3$/h (s.t.p.) of liquid oxygen are delivered by the pump 11 from the bottom 10 of the low-pressure column 2 to the top of the falling-film evaporators 3, 4. In this example, the height of the pressure column should be 14 m and the falling-film evaporators 3, 4 should each be 8 m high. The pump 11 therefore has to deliver 300,000 $m^3$/h (s.t.p.) of liquid oxygen to a total height of 14 m+8 m=22 m.

FIG. 2 shows a rectification unit which corresponds to FIG. 1 and in which the two falling-film evaporators 203, 204 are arranged in accordance with the invention. The pressure column 1 and the low-column 2 and also the pump 211 are placed at ground level. In this case, the falling-film evaporator 203 is located above the falling-film evaporator 204, so that a fluid which emerges from the bottom of the falling-film evaporator 203 can flow to the top end of the falling-film evaporator 204 under the force of gravity. In a similar way to that shown in FIG. 1, both falling-film evaporators 203, 204 are supplied with pressurized nitrogen from the pressure column 1 as heating medium via the lines 205, 206, 207. The nitrogen which emerges from the liquefaction passages is returned to the pressure column 1 via the lines 208, 209. The lower falling-film evaporator 204 is arranged in such a way that the outlet openings of its liquefaction passages are located above the pressure column 1. Consequently, the condensed nitrogen can be returned to the pressure column 1 without it being necessary to use a pump.

The liquid oxygen which is extracted from the bottom 10 of the low-pressure column 2 is partly pumped via line 215 to the top of the falling-film evaporator 203 and partly pumped via line 216 to the top of the falling-film evaporator 204. An excess of liquid oxygen which has not been evaporated emerges at the bottom end of the evaporation passages of the upper falling-film evaporator 203. The vapour produced and the excess liquid are separated in the separator 219. The excess liquid is then added to the top of the falling-film evaporator 204 via line 217, while the vapour produced is returned to the low-pressure column via the lines 232 and 218 or partially extracted as product via line 214. Line 230 is used for pressure compensation between the upper and lower ends of the falling-film evaporator 203.

The falling-film evaporator 204 is fed with the excess liquid from the upper falling-film evaporator 203 via line 217 and with fresh liquid via line 216. The vapour-liquid mixture which emerges from the evaporation passages of this evaporator 204 is returned to the low-pressure column 2 via line 218.

The boundary conditions for the air fractionation plant shown in FIG. 2 should correspond to those of the plant shown in FIG. 1. Once again, 50,000 $m^3$/h (s.t.p.) of gaseous oxygen are to be produced in each falling-film evaporator 203, 204. The ratio of the application of liquid oxygen and the quantity of vapour produced should likewise be three.

150,000 $m^3$/h (s.t.p.) of liquid oxygen have to be added to the upper falling-film evaporator 203. 50,000 $m^3$/h (s.t.p.) of oxygen vapour and 100,000 $m^3$/h (s.t.p.) of excess liquid are produced at the bottom end of this falling-film evaporator 203. 50,000 $m^3$/h (s.t.p.) of liquid oxygen is admixed to this 100,000 $m^3$/h (s.t.p.) of excess liquid and is delivered to this point by the pump 211. The mixture of excess liquid from the falling-film evaporator 203 and fresh oxygen is added to the lower falling-film evaporator 204. The lower falling-film evaporator 204 likewise delivers 50,000 $m^3$/h (s.t.p.) of oxygen in vapour form and 100,000 $m^3$/h (s.t.p.) of excess liquid.

In this case, the pump 211 has to deliver a total of 200,000 $m^3$/h (s.t.p.) of liquid oxygen. However, the overall delivery height is greater than with the arrangement shown in FIG. 1. This is because the pump 211 has to deliver the liquid oxygen over the height of the pressure column 1 and the two falling-film evaporators 203, 204. The overall delivery height is therefore 14 m+8 m+8 m=30 m.

The pump energy is proportional to the product Of the quantity of liquid and the total deliver height. The ratio of the pump energies in the arrangements show in FIGS. 1 and 2 can be calculated to be:

$$(300{,}000\ m^3/h\ (s.t.p.)*22\ m)/(200{,}000\ m^3/h\ (s.t.p.)*30\ m)=1.1.$$

Therefore, in the arrangement which is known in the prior art and is shown in FIG. 1, the outlay on energy is 10% higher than with the arrangement according to the intention shown in FIG. 2. Moreover, in the embodiment shown in FIG. 1, the pump 11 has to be designed for 300,000 $m^3$/h (s.t.p.) of liquid oxygen, while in the solution according to the invention a pump 211 which is designed for 200,000 $m^3$/h (s.t.p.) of liquid oxygen is sufficient. The pump 211 can therefore be designed to be one third smaller than the pump 11.

FIG. 3 shows an alternative embodiment of the arrangement shown in FIG. 2. This embodiment differs from that shown in FIG. 2 only in that the two falling-film evaporators 203, 204 are directly connected to one another. The gas-liquid separator 219 of the upper falling-film evaporator 203 is positioned directly on the upper level vessel 220 of the falling-film evaporator 204. Therefore, between the two falling-film evaporators 203, 204 there is a component 219, 220, in which the vapour produced in the upper falling-film evaporator 203 is separated from the corresponding excess liquid, and the excess liquid, together with the fresh liquid supplied is built up for the same reasons as have been explained in connection with the level vessel 20 shown in FIG. 1. As a result, the piping for the two falling-film evaporators 203, 204 is significantly simplified.

FIG. 4 shows the arrangement according to the invention of three falling-film evaporators. In this case, the excess liquid from the top falling-film evaporator 403 is added to the top of the evaporation passages of the falling-film evaporator 140 and the excess liquid from this falling-film evaporator 404 is in turn passed into the top of the falling-film evaporator 421. Each of the falling-film evaporators 403, 404, 421 is additionally supplied with fresh liquid oxygen from the bottom 10 of the low-pressure column 2 via the pump 411 and the lines 415, 416, 422. The individual falling-film evaporators 403, 404, 421 are connected Via pipelines 417, 423 in a similar manner to the embodiment shown in FIG. 2. Direct connection between the falling-film evaporators 402, 404, 421 in a similar manner to that illustrated in FIG. 3, so that the lines 417, 423 are eliminated, is also possible.

Overall, once again 100,000 $m^3$/h (s.t.p.) of oxygen in vapour form, i.e. 33,333 $m^3$/h (s.t.p.) of vapour in each falling-film evaporator 403, 404, 421, are to be produced. The quantity applied to the individual falling-film evaporators 403, 404, 421 should likewise once again amount to a factor of three.

Therefore, 100,000 $m^3$/h (s.t.p.) of liquid oxygen from the bottom 10 of the low-pressure column 2 have to be delivered to the falling-film evaporator 403. The result at the bottom end of the falling-film evaporator 403 is 33.333 $m^3$/h (s.t.p.) of oxygen in vapour form and 66,666 $m^3$/h (s.t.p.) of liquid oxygen. Therefore, a further 33,333 $m^3$/h (s.t.p.) of fresh oxygen have to be added to the falling-film evaporator 404 via line 416. Likewise, 33,333 $m^3$/h (s.t.p.) of oxygen in vapour form and 66,666 $m^3$/h (s.t.p.) of liquid oxygen are produced at the bottom end of the evaporator 404, so that it is also necessary for 33,333 $m^3$/h (s.t.p.) of liquid Oxygen to be fed to the bottom falling-film evaporator 421 by means of the pump 411. In total, therefore, 166,666 $m^3$/h (s.t.p.) of liquid oxygen have to be pumped over a total height of 14 m+8 m+8 m+8 m=38 m. Compared to three falling-film evaporators arranged in parallel (delivery quantity=300,000 $m^3$/h (s.t.p.); total delivery height=14 m+8 m=22 m), the radio of the corresponding pump energies tuns out to be $$(300{,}000\ m^3/h\ (s.t.p.)*22\ m)/(166{,}666\ m^3/h\ (s.t.p.)*38\ m)=1.046.$$

Therefore, compared to the conventional parallel arrangement of three falling-film evaporators, the result is an energy saving of almost 5%.

The following table shows the pump energy ratios for different pressure column heights of between 14 m and 24 m when the falling-film evaporator arrangement according to the invention is used compared to the conventional arrangement. The relative energy consumption with a parallel arrangement with the falling-film evaporators (one level), the inventive arrangement of two falling-film evaporators in series one above the other (two levels) and an inventive arrangement of three falling-film evaporators in series one above the other (three levels) is compared. The energy demand is in each case standardized with respect to the use of two falling-film evaporators (two levels) connected in series with a pressure column height or 14 m. The overall height of the falling-film evaporators is assumed to be 8 m.

TABLE 1

| Pressure column height | Relative energy demand (standardized to two levels with a pressure column height of 14 m) | | |
|---|---|---|---|
| [in meters] | 1 level | 2 levels | 3 levels |
| 14 | 1.10 | 1.00 | 1.06 |
| 15 | 1.15 | 1.03 | 1.08 |
| 16 | 1.20 | 1.07 | 1.11 |
| 17 | 1.25 | 1.10 | 1.14 |
| 18 | 1.30 | 1.13 | 1.17 |
| 19 | 1.35 | 1.17 | 1.19 |
| 20 | 1.40 | 1.20 | 1.22 |
| 21 | 1.45 | 1.23 | 1.25 |
| 22 | 1.50 | 1.27 | 1.28 |
| 23 | 1.55 | 1.30 | 1.31 |
| 24 | 1.60 | 1.33 | 1.33 |

Table 2 once again shows the energy demand of the pump as a function of the pressure column height, the variant having two levels being standardized to 1 for each pressure column height. The values entered in the "1 level" and "3 levels" columns therefore directly show the energy ratio of the respective arrangement to the corresponding arrangement with two falling-film evaporators connected in series.

TABLE 2

| Pressure column height | Relative energy demand (standardized to two levels) | | |
|---|---|---|---|
| [in meters] | 1 level | 2 levels | 3 levels |
| 14 | 1.10 | 1.00 | 1.06 |
| 15 | 1.11 | 1.00 | 1.05 |
| 16 | 1.12 | 1.00 | 1.04 |
| 17 | 1.14 | 1.00 | 1.04 |
| 18 | 1.16 | 1.00 | 1.03 |
| 19 | 1.17 | 1.00 | 1.02 |
| 20 | 1.18 | 1.00 | 1.02 |
| 21 | 1.18 | 1.00 | 1.01 |
| 22 | 1.18 | 1.00 | 1.01 |
| 23 | 1.19 | 1.00 | 1.00 |
| 24 | 1.20 | 1.00 | 1.00 |

It is clearly apparent that the arrangement according to the invention of two or more falling-film evaporators above one another provide energy benefits for all pressure column heights. In addition to the energy savings shown, the invention has the further advantage that a smaller and therefore less expensive pump can be used, since smaller quantities of liquid have to be delivered.

The invention claimed is:

1. A process for low-temperature fractionation of air in a rectification unit which comprises a pressure column, a low-pressure column and a condenser-evaporator system having at least a first and a second falling-film evaporators, said process comprising:

introducing oxygen-rich liquid from the bottom (10) of said low-pressure column into evaporation passages (203, 403) within said first falling-film evaporator and partially evaporating said oxygen-rich liquid, separating a gas-liquid mixture which emerges from the evaporation passages of said first falling-film evaporator into a gas and unevaporated oxygen-rich liquid, introducing said unevaporated oxygen-rich liquid from said first falling-film evaporator into said second falling-film evaporator, and introducing oxygen-rich liquid from the bottom (10) of said low-pressure column (2) introduced into evaporation passages of said second falling-film evaporator (204, 404).

2. A process according to claim 1, the gas separated from said gas-liquid mixture which emerges from the evaporation passages of said first falling-film evaporator is delivered to said low-pressure column.

3. A process according to claim 1, wherein unevaporated oxygen-rich liquid discharged from said second falling-film evaporator (404) is passed into a third falling-film evaporator (421).

4. A process according to claim 1, wherein said first and second falling-film evaporators are arranged in a series which consists of said first and second falling-film evaporators.

5. A process according to claim 1, wherein the amount of oxygen-rich liquid fed to said first and second falling-film evaporators (203, 403, 204, 404) is two to five times the amount of oxygen in vapor form produced in the said first and second falling-film evaporator (203, 403, 204, 404).

6. A process according to claim 1, wherein said unevaporated oxygen-rich liquid which emerges from said first falling-film evaporator (203, 403) flows into said second falling-film evaporator (204, 404) due to static pressure.

7. A process according to claim 1, wherein condensed nitrogen which emerges from said second falling-film evaporator (204) flows into the pressure column (1) due to static pressure.

8. A process according to claim 1, wherein said pressure column (1) and said low-pressure column (2) are arranged next to one another.

9. A process according to claim 2, wherein unevaporated oxygen-rich liquid discharged from said second falling-film evaporator (404) is passed into a third falling-film evaporator (421).

10. A process according to claim 2, wherein said first and second falling-film evaporators are arranged in a series which consists of said first and second falling-film evaporators.

11. A process according to claim 3, wherein said first and second falling-film evaporators are arranged in a series which consists of said first and second falling-film evaporators.

12. A process according to claim 9, wherein said first and second falling-film evaporators are arranged in a series which consists of said first and second falling-film evaporators.

13. A process according to claim 2, wherein the amount of oxygen-rich liquid fed to said the first and second falling-film evaporators (203, 403, 204, 404) is two to five times the amount of oxygen in vapor form produced in the said first and second falling-film evaporator (203, 403, 204, 404).

14. A process according to claim 3, wherein the amount of oxygen-rich liquid fed to said first and second falling-film evaporators (203, 403, 204, 404) is two to five times the amount of oxygen in vapor form produced in the said first and second falling-film evaporator (203, 403, 204, 404).

15. A process according to claim 4, wherein the amount of oxygen-rich liquid fed to said first and second falling-film evaporators (203, 403, 204, 404) is two to five times the amount of oxygen in vapor form produced in the said first and second falling-film evaporator (203, 403, 204, 404).

16. A process according to claim 9, wherein the amount of oxygen-rich liquid fed to said first and second falling-film evaporators (203, 403, 204, 404) is two to five times the amount of oxygen in vapor form produced in the said first and second falling-film evaporator (203, 403, 204, 404).

17. A process according to claim 12, wherein the amount of oxygen-rich liquid fed to said first and second falling-film evaporators (203, 403, 204, 404) is two to five times the amount of oxygen in vapor form produced in the said first and second falling-film evaporator (203, 403, 204, 404).

18. A process according to claim 2, wherein said unevaporated oxygen-rich liquid which emerges from said first falling-film evaporator (203, 403) flows into said second falling-film evaporator (204, 404) due to static pressure.

19. A process according to claim 2, wherein condensed nitrogen which emerges from said second falling-film evaporator (204) flows into the pressure column (1) due to static pressure.

20. A process according to claim 2, wherein said pressure column (1) and said low-pressure column (2) are arranged next to one another.

21. A process according to claim 1, wherein unevaporated oxygen-rich liquid which emerges from said second falling-film evaporator flows into said low-pressure column due to static pressure.

22. A process according to claim 21, wherein said unevaporated oxygen-rich liquid which emerges from said first falling-film evaporator (203, 403) flows into said second falling-film evaporator (204, 404) due to static pressure, and condensed nitrogen which emerges from said second falling-film evaporator (204) flows into the pressure column (1) due to static pressure.

23. A process according to claim 1, further comprising introducing nitrogen gas from the top of said pressure column into liquefaction passages of said first falling-film evaporator and said second falling-film evaporator.

24. A process according to claim 23, further comprising introducing nitrogen which emerges from said liquefaction passages into said pressure column.

25. A process according to claim 1, wherein a gas-liquid mixture discharged from said second falling-film evaporator is passed into said low-pressure column.

26. A process according to claim 3, wherein oxygen-rich liquid from the bottom (10) of said low-pressure column is introduced into the evaporation passages within said third falling-film evaporator (421).

27. A process according to claim 1, a portion of the gas separated from said gas-liquid mixture which emerges from the evaporation passages of said first falling-film evaporator is removed as product.

28. A process according to claim 2, further comprising:

introducing nitrogen gas from the top of said pressure column into liquefaction passages of said first falling-film evaporator and said second falling-film evaporator, introducing nitrogen which emerges from said liquefaction passages into said pressure column delivering unevaporated oxygen-rich liquid which emerges from said second falling-film evaporator flows into said low-pressure column, and delivering condensed nitrogen which emerges from said second falling-film evaporator (204) flows into the pressure column (1).

* * * * *

UNITED STATES PATENT AND TRADEMARK OFFICE

CERTIFICATE OF CORRECTION

PATENT NO. : 7,134,297 B2
APPLICATION NO. : 10/365610
DATED : November 14, 2006
INVENTOR(S) : Horst Corduan It is certified that error appears in the above-identified patent and that said Letters Patent is hereby corrected as shown below:

Column 8, line 21, reads “claim 1, the” should read -- claim 1, wherein the --
Column 8, line 66, reads “said the first” should read -- said first --
Column 10, line 21, reads “claim 1, a” should read -- claim 1, wherein a --
Column 10, line 30, reads “pressure column” should read -- pressure column, --

Signed and Sealed this

Twelfth Day of August, 2008

JON W. DUDAS
*Director of the United States Patent and Trademark Office*